US007331274B2

(12) United States Patent
Sugiura et al.

(10) Patent No.: US 7,331,274 B2
(45) Date of Patent: Feb. 19, 2008

(54) SLIDING FILM, SLIDING MEMBER, COMPOSITION FOR SLIDING FILM, SLIDING DEVICE, SWASH-PLATE TYPE COMPRESSOR, PROCESS FOR FORMING SLIDING FILM, AND PROCESS FOR PRODUCING SLIDING MEMBER

(75) Inventors: Manabu Sugiura, Kariya (JP); Takahiro Sugioka, Kariya (JP); Hiroyuki Kawaura, Seto (JP); Takao Kobayashi, Seto (JP); Goro Watanabe, Tajimi (JP); Kenichi Suzuki, Nagoya (JP); Hideo Tachikawa, Nisshin (JP); Hideo Hasegawa, Nagoya (JP)

(73) Assignees: Kabushiki Kaisha Toyota Jidoshokki, Kariya-shi (JP); Kabushiki Kaisha Toyota Chuo Kenkyusho, Aichi-gun (JP)

( * ) Notice: Subject to any disclaimer, the term of this patent is extended or adjusted under 35 U.S.C. 154(b) by 96 days.

(21) Appl. No.: 11/133,848

(22) Filed: May 20, 2005

(65) Prior Publication Data

US 2005/0257684 A1 Nov. 24, 2005

(30) Foreign Application Priority Data

May 21, 2004 (JP) ..... 2004-152124

(51) Int. Cl.
*F01B 3/00* (2006.01)
*F01B 31/10* (2006.01)

(52) U.S. Cl. ..... 92/155; 92/71

(58) Field of Classification Search ..... 92/12.2, 92/71, 155
See application file for complete search history.

(56) References Cited

U.S. PATENT DOCUMENTS

| | | | | |
|---|---|---|---|---|
| 3,427,244 | A * | 2/1969 | Boes | 75/230 |
| 4,703,076 | A | 10/1987 | Mori | 524/420 |
| 6,123,009 | A | 9/2000 | Kanayama et al. | 92/71 |
| 6,189,434 | B1 | 2/2001 | Kawaguchi et al. | 92/71 |
| 6,378,415 | B1 | 4/2002 | Sugiura et al. | 92/71 |
| 6,602,354 | B2 * | 8/2003 | Kanematsu et al. | 148/240 |
| 6,752,065 | B2 | 6/2004 | Sugioka et al. | 92/12.2 |
| 6,983,681 | B2 * | 1/2006 | Iwata et al. | 92/12.2 |

FOREIGN PATENT DOCUMENTS

| | | |
|---|---|---|
| DE | 36 16 360 | 11/1986 |
| EP | 1 236 914 | 9/2002 |
| EP | 1 036 938 | 6/2006 |

(Continued)

*Primary Examiner*—Michael Leslie
(74) *Attorney, Agent, or Firm*—Morgan & Finnegan, LLP

(57) ABSTRACT

A sliding film includes a solid lubricant, a binder resin, and a low-melting-point material. The binder resin is for holding the solid lubricant on a surface of a substrate, and exhibits a glass transition temperature. The low-melting-point material exhibits a melting point lower than the glass transition temperature of the binder resin. The low-melting-point material demonstrates a latent heat which can absorb frictional heat generated between sliding members, and accordingly retards the degradation of the binder resin. As a result, the sliding film produces high seizure resistance.

27 Claims, 8 Drawing Sheets
(1 of 8 Drawing Sheet(s) Filed in Color)

FOREIGN PATENT DOCUMENTS

| | | |
|---|---|---|
| JP | 11-13638 | 5/1989 |
| JP | 8-199327 | 8/1996 |
| JP | 11-193780 | 7/1999 |
| JP | 11-201037 | 7/1999 |
| JP | 2000-265953 | 9/2000 |
| JP | 2002-188641 | 7/2002 |
| JP | 2003-138287 | 5/2003 |
| JP | 2003-183685 | 7/2003 |

* cited by examiner

SLIDING FILM, SLIDING MEMBER, COMPOSITION FOR SLIDING FILM, SLIDING DEVICE, SWASH-PLATE TYPE COMPRESSOR, PROCESS FOR FORMING SLIDING FILM, AND PROCESS FOR PRODUCING SLIDING MEMBER

BACKGROUND OF THE INVENTION

1. Field of the Invention

The present invention relates to a sliding member formed on a sliding surface, a composition used for forming the sliding film, a sliding member comprising the sliding film, a sliding device made of the sliding member, and a swash-plate type compressor, one of the examples of the sliding device, as well as a process for forming the sliding film and a process for producing the sliding member.

2. Description of the Related Art

Apparatuses to be equipped with automobiles, such as engines and swash-plate type compressors for air conditioners, are provided with sliding members for sliding operations. When taking a swash-plate type compressor as an example, it is provided with pistons sliding linearly, a cylinder bore contacting slidably with the pistons, a swash plate sliding rotationally, shoes contacting slidably with the swash plate, a main shaft, and bearings holding the main shaft while contacting slidably therewith. Onto sliding surfaces of such sliding members, lubricants are usually supplied to actively carry out lubrication. In the case of swash-plate type compressors, mist-like lubricants, which exist inside swash-plate type compressors, hold lubricity between sliding surfaces basically.

However, swash-plate type compressors immediately after start-up or abrupt load fluctuations might possibly put conditions between the sliding surfaces into poor lubrication condition or non-lubrication condition, even temporarily. Even if such is the case, it is preferable to secure stable sliding characteristics between the sliding surfaces by inhibiting seizure between the sliding surfaces, for example.

From such a view point, sliding films including solid lubricants are disposed on the surfaces of swash plates in the case of swash-plate type compressors, for instance. Japanese Unexamined Patent Publication (KOKAI) No. 8-199,327, Japanese Unexamined Patent Publication (KOKAI) No. 11-193,780 and Japanese Unexamined Patent Publication (KOKAI) No. 2003-183,685, for example, disclose such sliding films. Specifically, Japanese Unexamined Patent Publication (KOKAI) No. 8-199,327 discloses a swash plate whose opposite surfaces are covered with a solid-lubricant layer (i.e., a sliding film) in which a synthetic resin puts together solid lubricants, such as $MOS_2$, polytetrafluoroethylene (hereinafter abbreviated to as "PTFE") and graphite (hereinafter abbreviated to as "Gr" wherever appropriate). Japanese Unexamined Patent Publication (KOKAI) No. 11-193,780 discloses a swash plate one of whose surfaces, subjected to large loads in pistons' compression stroke, is provided with a solid-lubricant layer, and the other one of whose surface is provide with a thermally-sprayed layer. Japanese Unexamined Patent Publication (KOKAI) No. 2003-183,685 discloses a swash plate whose opposite surfaces are covered with a solid-lubricant layer in which Ni, Fe, Cr and Co are mixed in addition to $MoS_2$, PTFE and graphite.

However, due to downsizing, weight saving and the other severe requirements, larger loads have acted between sliding members more than conventionally. For swash-plate type compressors which are subjected to such larger loads, it has been becoming not necessarily easy to secure satisfactory seizure resistance by simply providing sliding surfaces with the above-described conventional solid-lubricant layers.

SUMMARY OF THE INVENTION

The present invention has been developed in view of the aforementioned circumstances. It is therefore an object of the present invention to provide a sliding film which demonstrates better seizure resistance than that of the above-described conventional solid-lubricant layers. Moreover, it is another object of the present invention to provide a composition used for forming the sliding film, a sliding member comprising the sliding film, a sliding device made of the sliding member, and a swash-plate type compressor, one of the examples of the sliding device. In addition, it is still another object of the present invention to provide a process for forming the sliding film and a process for producing the sliding member.

Note that Japanese Unexamined Patent Publication (KOKAI) No. 11-193,780 also exemplifies metals, such as tin (Sn), lead (Pb) and indium (in), as solid lubricants included in the sliding film. However, it does not at all disclose sliding films in which Sn, Pb and In are mixed actually. It simply regards these metals as some of solid lubricants only. Moreover, it discloses to carry out Sn-based plating or Sn-based thermal spraying as well. However, it merely considers these treatments some of undercoating treatments for the sliding film including solid lubricants alone.

Japanese Unexamined Patent Publication (KOKAI) No. 2003-183,685 also discloses that a nickel fine powder mixed in the solid-lubricant layer has an action of facilitating $MoS_2$ and graphite present in the solid lubricant layer to adhere onto mating sliding surfaces. However, such an action is totally different from the actions of Sn and so on, later-described low-melting-point materials according to the present invention. Therefore, low-melting-point materials according to the present invention, which will be hereinafter described in detail, distinguish over nickel disclosed in Japanese Unexamined Patent Publication (KOKAI) No. 2003-183,685 completely in view of engineering concept.

Swash-plate type compressors have been exemplified so far. The above descriptions, however, are similarly applicable to vane type compressors and scroll type compressors as well as the other types of compressors. Moreover, not limited to compressors, the above descriptions are likewise pertinent to sliding devices in general, which operate under severe conditions.

Hence, the present inventors have been studying earnestly in order to solve the problems, and have been repeated trials and errors. As a result, they have thought of further including a low-melting-point material (e.g., Sn) anew in sliding films, in addition to conventional solid lubricants, and have also confirmed that the resulting sliding films demonstrate good seizure resistance. Thus, they have arrived at completing the present invention.

Sliding Film

For example, a sliding film according to the present invention is a sliding film, which comprises:

- a solid lubricant;
- a binder resin for holding the solid lubricant on a surface of a substrate, the binder resin exhibiting a glass transition temperature; and
- a low-melting-point material exhibiting a melting point lower than the glass transition temperature of the binder resin.

When the present sliding film is disposed on a surface of a substrate, the seizure resistance is upgraded between the substrate and its mating members, compared with the substrate provided with the conventional sliding films. Accordingly, the sliding devices, which are equipped with the resultant substrate, are enhanced in view of the reliability and durability. Moreover, it is possible to expect that the present sliding film not only upgrades the seizure resistance but also it enhances the wear resistance of sliding members and reduce friction coefficients between sliding surfaces. Note that, in addition to the upgraded seizure resistance, the enhanced wear resistance and the reduced friction coefficients will be hereinafter collectively referred to as "good sliding characteristics" wherever appropriate.

It has not been definite yet why the present sliding film demonstrates good sliding characteristics. However, it is believed that a low-melting-point material included in the present sliding film absorbs frictional heat resulting from sliding operations at least effectively under severe lubrication conditions, such as poor lubrication conditions or non-lubrication condition. Thus, the present sliding film is inhibited from being degraded by the frictional heat so that the longevity of the present sliding film is extended. As a result, it is believed at present that the seizure resistance of the present sliding film is upgraded. The advantage will be hereinafter described in detail.

Conventionally, even when poor lubrication conditions and non-lubrication condition is established, substrates and their mating members (hereinafter both are referred to as "sliding members" wherever appropriate) have been provided with sliding films including solid lubricants in order to inhibit the seizure between the substrates and mating members. However, as described above, it has been becoming not necessarily easy for conventional sliding films to secure satisfactory seizure resistance because the operating environments and lubrication conditions for sliding members have become much severer recently.

The present inventors considered that the reason for the disadvantage is that the frictional heat has degraded conventional films quickly. That is, when sliding members move slidably, the frictional heat generates more or less. When a lubricant is supplied between sliding surfaces sufficiently, the degradation of sliding films is naturally less likely to occur because a lubricant film being present between the sliding surfaces reduces the friction coefficient between the sliding surfaces and disperse the pressure exerted therebetween, and because the lubricant even radiates the frictional heat so that the frictional heat generates less.

However, when sliding surfaces are put into poor lubrication conditions or non-lubrication condition, it has become hardly possible to expect the advantages resulting from lubrication. Even if solid lubricants reduce the friction coefficients between sliding surfaces more or less, the frictional heat increases sharply after a predetermined time has elapsed, and consequently the temperatures of sliding films start rising rapidly.

In sliding films, solid lubricants are usually held to the surfaces of sliding members by binder resins. Polyamide-imide (hereinafter abbreviated to as "PAI"), a representative example of the binder resins with good heat resistance, has a heat-resistant temperature of from 400 to 500° C. approximately However, when the friction heat raises the temperatures of sliding films, even such a resin with good heat resistance has undergone softening (including glass transition) and degradation, and even destruction. As a result, the resin loses the ability to hold solid lubricants onto the surfaces of sliding members. Accordingly, sliding members have come to contact slidably with mating members directly without intervening sliding films. Consequently, sliding members are believed to result in seizure.

Even in the present sliding film, its temperature rises rapidly under severe sliding circumstances similarly.

However, the present sliding film comprises a low-melting-point material whose melting point is lower than the glass transition point of a binder resin and which is mixed with the binder resin. When the frictional heat starts raising the temperature of the present sliding film rapidly, the low-melting-point absorbs the frictional heat abundantly by the latent heat, which is far larger than the specific heat, before the binder resin comes to soften. As a result, the temperature of the present sliding film is inhibited from increasing. Accordingly, it is possible to inhibit or retard the softening of the binder resin, and eventually the degradation of the present sliding film. Consequently, it is possible to keep a solid lubricant holding firmly onto the surfaces of sliding members for a much longer period of time.

It follows that, in the present sliding film, the low-melting-point material, which exhibits a melting point lower than the glass transition temperature of the binder resin, inhibits or retards the temperature increment of the present sliding film resulting from the frictional heat. Thus, the present sliding film keep exhibiting the sliding characteristics stably much longer than conventionally. As a result, it is believed that the present sliding film upgrades the seizure resistance between sliding members remarkably. However, these operations and advantages resulting from the low-melting-point material are only some of the factors that the present sliding film demonstrates good seizure resistance. It should be noted that the above-described mechanism cannot account for all of the good sliding characteristics of the present sliding film. As described later, when a specific component (e.g., a sliding-product-forming element) is present on the sliding surfaces of mating members, the present inventors confirmed that the specific component and the low-melting-point material included in the present sliding film form a new sliding product. The resultant new sliding product is believed to demonstrate advantages of further improving the sliding characteristics, such as reducing the friction coefficients between sliding surfaces and enhancing the wear resistance, in addition to the above-described upgraded seizure resistance.

Note that, in the present invention, the glass transition temperature of a binder resin is introduced as a threshold value for the melting point of a low-melting-point material because the glass transition temperature is an important characteristic for indexing the heat resistance of resin, especially that of polymer. Also note that the present invention involves conceptually component parts comprising sliding films alone virtually, for example, bearings.

Sliding Member

It is possible to grasp the present invention as a sliding member comprising the above-described present sliding film. For instance, the present invention can be adapted to a sliding member, comprising:

a substrate; and the sliding film set forth in claim 1 and formed on a surface of the substrate.

A representative example of such a sliding member is swash plates for swash-plate type compressors.

Sliding Device and Swash-Plate Type Compressor

It is possible to grasp the present invention as a sliding device comprising the above-described present sliding film. For example, the present invention can be adapted to a sliding device, comprising:

a substrate on which the sliding film set forth in claim 1 is formed; and a mating member contacting slidably with the sliding film of the substrate.

Such a sliding device can be, for instance, swash-plate type compressors, or compressors other than swash-plate type, or cannot be compressors at all. Hereinafter, the present sliding device will be described with reference to a swash-plate type compressor taken as a representative example of the sliding device. Various swash-plate type compressors are available. For example, there are variable-capacity swash-plate type compressors, constant-capacity swash-plate type compressors, single-headed swash-plate type compressors, and double-headed swash-plate type compressors.

A specific example is a swash-plate type compressor, comprising:

a main shaft;

a swash plate rotating together with the main shaft;

a cylinder block having a cylinder-shaped cylinder bore extending axially and opened on a swash-plate side;

a piston having an engager engaging with the swash plate, and being driven by the swinging swash plate, and a head extending continuously from the engager, being fitted into the cylinder bore of the cylinder block, and reciprocating in the cylinder bore depending on the swinging swash plate; and a pair of shoes held swingably to the engager of the piston, and contacting slidably with a surface of the swash plate. In this instance, it is appropriate that the present sliding film can be formed on a surface of the swash plate and/or surfaces of the shoes. Note that the number of pistons can be singular or plural. A piston is provided with a pair of shoes. Naturally, a plurality of pistons are provided with a plurality of paired shoes.

Composition for Sliding Film

It is possible to grasp the present invention as a composition for sliding film, a raw material for forming the present sliding film. For instance, the present invention can be adapted to a composition for sliding films, the composition comprising:

a solid lubricant;

a binder resin exhibiting a glass transition temperature; and a low-melting-point material exhibiting a melting point lower than the glass transition temperature of the binder resin, whereby producing the present sliding film.

Specific examples of such a sliding-film composition can be paints for sliding films, and transfer films for sliding films.

Process for Forming Sliding Film

It is possible to grasp the present invention as a process for forming the sliding film. Firstly, the present invention can be adapted to a process for forming a sliding film, the process comprising:

applying a paint for sliding films onto a surface of a substrate, the paint comprising:

a varnish of a binder resin exhibiting a glass transition temperature;

a low-melting-point material exhibiting a melting point lower than the glass transition temperature of the binder resin, and dispersed in the varnish; and a solid lubricant dispersed in the varnish; and baking a paint film, formed after the applying step, by heating, thereby producing the present sliding film.

Secondly, the present invention can be adapted to a process for forming a sliding film, the process comprising:

transferring a transfer film, made by printing a paste, onto a surface of a substrate, the paste comprising:

a binder resin exhibiting a glass transition temperature;

a low-melting-point material exhibiting a melting point lower than the glass transition temperature of the binder resin, and mixed with the binder resin; and a solid lubricant mixed with the binder resin; and baking the transfer film formed, on the surface of the substrate after the transferring step, by heating, thereby producing the present sliding film.

Process for Producing Sliding Member

It is possible to grasp the present invention as a process for forming the present sliding member. For example, the present invention can be adapted to a process for producing a sliding member by the above-described first or second process for forming a sliding film.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Figure 1:
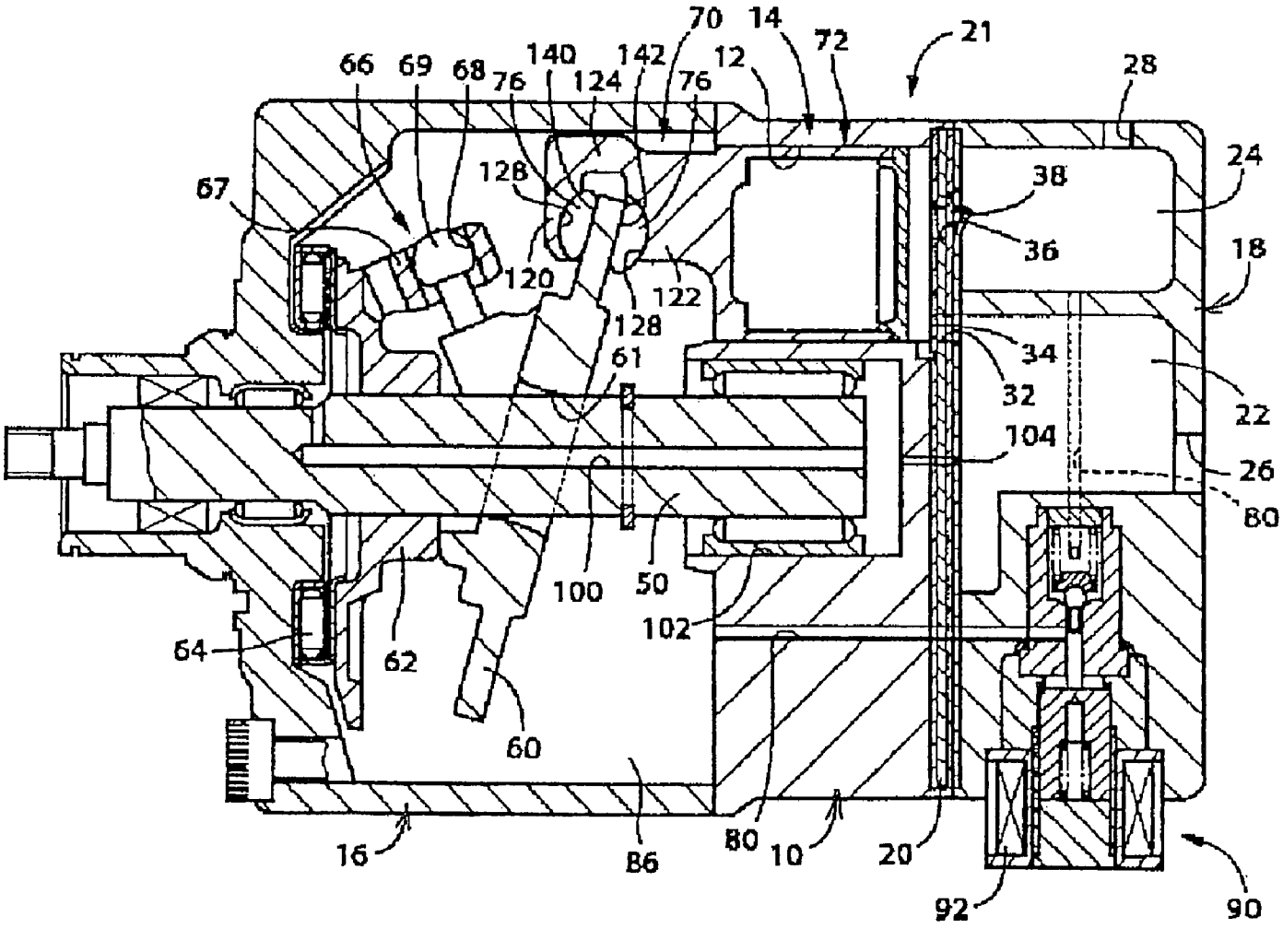
FIG. 1 is a cross-sectional view of a swash-plate type compressor, a sliding device according to an example of the present invention.

Having generally described the present invention, a further understanding can be obtained by reference to the specific preferred embodiments which are provided herein for the purpose of illustration only and not intended to limit the scope of the appended claims.

The present invention will be hereinafter described in detail with reference to specific embodiments of the present invention. However, it should be noted that, not to mention the following descriptions on the specific embodiments, descriptions set forth in the present specification are appropriately applicable not only to the sliding film according to the present invention but also to the sliding member, composition for sliding films, sliding device, swash-plate type compressor, process for forming a sliding film and process for producing a sliding member according to the present invention. Moreover, it should be also noted that it depends on objects and performance requirements which one of the following specific embodiments is optimal.

(1) Low-Melting-Point Material

The low-melting-point material is one which exhibits a melting point lower than a glass transition temperature of the binder resin, the other component element of the present sliding film. The low-melting-point material is selected and determined in relation to the binder resin. As representative examples of the low-melting-point material, it is possible to think of metallic materials, such as metallic simple substances, alloys and intermetallic compounds. However, not limited to these, the low-melting-point material can be compounds of metallic elements and nonmetallic elements. Moreover, not limited to inorganic materials, the low-melting-point material can be organic elements, such as synthetic resins. The low-melting-point material can comprise a single species of the various materials, or can comprise a plurality of species combining them appropriately.

When considering employing polyimide (hereinafter referred to as "PI") or polyamide-imide (hereinafter referred to as "PAI"), representative resins with good heat resistance, as the binder, they exhibit glass transition temperatures Tg of from 200 to 500° C. approximately. Taking this fact into consideration, some examples of the low-melting-point material will be named hereinafter. Note that numerical values in parentheses specify the exemplified low-melting-point materials' melting points.

As metallic simple substances, simple substances of low-of melting-point metals are available, such as indium (In: 157° C.), tin (Sn: 232° C.), bismuth (Bi: 271° C.) and lead (Pb: 327° C.). Naturally, the low-melting-point material can be alloys of these low-melting-point metals. As examples of Sn-based alloys with eutectic compositions, it is possible to name Sn-52In (118° C.), Sn-58Bi (139° C.), Sn-37Pb (183° C.), Sn-3.5Ag (221° C.), and Sn-0.7Cu (227° C.). Moreover, Sn-3Ag-0.5Cu (217-220° C.), and Sn-3Ag-2Bi-1In (209-217° C.) are available. Note that the numerical values in parentheses following the ternary and quaternary alloys represent the "solidus temperature-liquidus temperature." Also note that all of the alloy compositions are expressed in % by mass when the entirety is taken as 100% by mass.

Thus, it is possible to think of various species as the low-melting-point material. However, the low-melting-point material can preferably be at least one member selected from the group consisting of simple tin, tin alloys and tin compounds. These Sn-based materials exhibit low melting points as well as large latent heats. Moreover, Sn is an element which is available less expensively relatively and exerts less loads to environments.

It is difficult to explicitly specify the proportion of the low-melting-point material in the present sliding film, because the proportion of the low-melting-point material is determined appropriately depending on the specifications of the present sliding film and the types and proportions of using solid lubricants and binder resins. However, the lower limit of the proportion of the low-melting-point material can preferably be 0.1% by mass, further preferably 0.5% by mass, furthermore preferably 2% by mass, for example, and the upper limit can preferably be 60% by mass, further preferably 50% by mass, furthermore preferably 40% by mass, for instance, when the entire present sliding film is taken as 100% by mass. Note that these upper and lower limits can be combined appropriately.

When the low-melting-point material is present even in a small amount in sliding films, it is possible to enhance the durability of sliding films, and to upgrade the seizure resistance. However, when the content of the low-melting-point material is too less, the low-melting-point material effects the advantages less. On the other hand, when the content of the low-melting-point material is too much, it is not preferable because the contents of the solid lubricant and binder resin decreases relatively to result in lowering sliding member's own characteristics.

The low-melting-point material can preferably be dispersed uniformly in the present sliding film or adjacent to the superficial layer of the present sliding film. Accordingly, the low-melting-point material can preferably be granular or particulate. The specific forms of the low-melting-point material, such as the particle diameters and aspect ratios, do not matter, but can be selected appropriately taking the specifications of the present sliding film and the availability and cost of low-melting-point materials into consideration. It is possible, however, to give examples as follows: the particle diameter of the low-melting-point material can preferably fall in a range of from 0.1 to 100 μm, further preferably from 0.1 to 50 μm, furthermore preferably from 0.5 to 20 μm, moreover preferably from 1 to 5 μm, approximately. The low-melting-point material with excessively small particle diameter is not only difficult to procure but also is highly expensive. On the other hand, the low-melting-point material with excessively large particle diameter is not preferable, because it might project out of the present sliding film. That is, the maximum particle diameter of the low-melting-point material can preferably be the film thickness of desirable present sliding film or less. However, depending on the specifications of sliding members and sliding devices, the once formed present sliding film might be used after it is subjected to polishing. Consequently, "the maximum particle diameter of the low-melting-point material being the film thickness of the present sliding film or less" is not the essential requirement of the present invention at all.

Note that the raw material powders used for the low-melting-point materials can be mechanically pulverized powders, or atomized powders, and their production methods do not matter. Also note that, even when using a powdery low-melting-point material, it is not necessary for the low-melting-point material to hold the initial shape at the time of raw material in the present sliding film. Moreover, the particulate form of a low-melting-point material can be changed by grinding or polishing the surface of the present sliding film after forming the present sliding film. In addition, when the present sliding film is heated to a temperature of less than the glass transition temperature of a binder resin, the low-melting-point material can melt entirely or partially to diffuse in the present sliding film.

Not limited to the above-described forms, it is imaginable that the low-melting-point material might change the existing form materially. For example, when an Sn powder is used as the raw material powder for a low-melting-point material and the present sliding film is formed in which Sn particles are dispersed, it is naturally conceivable that Sn react with the other elements to turn into compounds or to form alloys. These new products are included in the present low-melting-point material as far as they exhibit a melting point less than the glass transition temperature of a binder resin. Note that the new products include a later-described sliding product. That is, the component element, referred to as the low-melting-point material in the present invention, is not required to keep the form of starting material as it is in the present sliding film, but can be changed into the other forms after forming the present sliding film. For instance, as the new products, it is possible to think of low-melting-point alloys, such as the aforementioned Sn-0.7Cu and Sn-3.5Ag. In the formation stage of the present sliding film, an adequate amount of a Cu or Ag powder can be mixed with an Sn powder. Thereafter, in the stage of baking the binder resin of the present sliding film or using the present sliding film, Sn and Cu or Ag can form Sn—Cu alloys or Sn—Ag alloys to turn into new low-melting-point materials.

The content of a low-melting-point material in the present sliding film is believed to greatly affect the total quantity of frictional heat which the low-melting-point material receives before the binder resin undergoes glass transition at the glass transition temperature. However, when the low-melting-point material receives the frictional heat in a short period of time, not limited to the content, the particle-diameter distribution of the low-melting-point material is believed to affect the temperature increment of the present sliding member. Therefore, it is advisable to control the proportion and form of a low-melting-point material depending on the required specifications of the present sliding film.

(2) Binder Resin

The binder resin fixes firmly or holds the solid lubricant and low-melting-point material onto the surfaces of substrates. The types of the binder resin do not matter particularly. However, the binder resin itself can further preferably exhibit good sliding characteristics.

As for the binder resin, it is possible to appropriately select at least one member from the group consisting of thermosetting resins, thermoplastic resins, non-thermoplastic resins, crystalline resins and non-crystalline resins, for example. Specifically, for instance, it is possible to name PAI (280° C.), polyimide (hereinafter referred to as "PI," 410° C.), polyether ether ketone (hereinafter referred to as "PEEK," 143° C.), epoxy resins, phenol resins, unsaturated polyesters, liquid-crystal polyalate (hereinafter referred to as "LCP," 360° C.), polyethersulfone (hereinafter abbreviated to as "PES," 230° C.), and polyether-imide (hereinafter referred to as "PEI," 217° C.). Note that the numerical values in parentheses specify the exemplified binder resins' glass transition temperatures Tg. Especially, PAI is an appropriate option as the binder resin which is good in terms of the sliding characteristics, such as wear resistance, the heat resistance and the economical efficiency.

The binder resin can not necessarily comprise a single species of resins, or can comprise a plurality of species of resins mixed together. Moreover, the binder resin cannot comprise a simple resin, but can further comprise reinforcing particles in addition to a resin, reinforcing particles which are dispersed in the resin to reinforce the resin's function as binder. Moreover, a coupling agent can be further used in order to improve the conformability of not only the solid lubricant and low-melting-point material but also reinforcing particles in the binder resin whenever necessary. In addition, solvents can be used in dispersing the solid lubricant and so on in the binder resin.

The proportion of the binder resin in the present sliding film can be considered the balance apart from the appropriate amounts of the solid lubricant and low-melting-point material. However, the lower limit of the proportion of the binder resin can preferably be 20% by volume, further preferably 30% by volume, for example, and the upper limit can preferably be 80% by volume, further preferably 70% by volume, for instance, when the entire present sliding film is taken as 100% by volume. Note that these upper and lower limits can be combined appropriately.

Too less proportion of the binder resin causes the solid lubricant and low-melting-point material to come off so that the wear resistance of the resulting sliding films has lowered. On the contrary, too much proportion of the binder resin decreases the proportions of the solid lubricant and low-melting-point material too much relatively so that the sliding characteristics of the resultant sliding films have degraded. It is preferable to appropriately control the proportion of the binder resin depending on using solid lubricants and so forth and the specifications of the present sliding film.

(3) Solid Lubricant

The types of the solid lubricant do not matter. Not only a single species of solid lubricants can be used, but also a plurality of species of solid lubricants can be mixed to use. When using a plurality of species of solid lubricants, the individual solid lubricants compensate the sliding characteristics with each other so that it is possible to produce sliding films with good sliding characteristics when viewed as a whole.

As for such a solid lubricant, the following are available: PTFE, ethylene-tetrafluoroethylene (hereinafter referred to as "ETFE"), tetrafluoroethylene-hexafluoropropylene copolymer (hereinafter referred to as "FEP"), molybdenum disulfide ($MOS_2$), tungsten disulfide ($WS_2$), calcium fluoride ($Caf_2$), graphite (C), and boron nitride (BN).

The proportion of the solid lubricant in the present sliding film depends on the specifications of the present sliding film. However, the lower limit of the proportion of the solid lubricant can preferably be 20% by volume, further preferably 30% by volume, for example, and the upper limit can preferably be 80% by volume, further preferably 70% by volume, for instance, when the entire present sliding film is taken as 100% by volume. Note that these upper and lower limits can be combined appropriately.

In particular, the solid lubricant can preferably comprise at least one member selected from the group consisting of PTFE, $MoS_2$ and graphite. Moreover, the solid lubricant can further preferably comprise the three of them compounded together. The proportions of the independent solid lubricants can preferably from 10 to 40% by volume for PTFE, from 5 to 30% by volume for $MoS_2$, and from 10 to 30% by volume for graphite, when the entire present sliding film is taken as 100% by volume. In this instance, it is preferable to use PAI in an amount of from 50 to 80% by volume with respect to the entire present sliding film taken as 100% by volume.

Too less solid-lubricant content has lowered the sliding characteristics of the resulting sliding films. On the other hand, too much solid-lubricant content results in decreasing the proportions of the binder resin and low-melting-point material relatively and causes the solid lubricant to come off so that the wear resistance of the resultant sliding films has degraded. It is preferable to appropriately control an optimum content of the solid lubricant depending on the types of solid lubricant and the specifications of the present sliding film.

(4) Substrate, Mating Member and Sliding Member

A substrate is the base of sliding member. A sliding member according to the present invention comprises a substrate whose at least one surface is covered with the present sliding film. The material of the substrate can be any one of aluminum alloys, magnesium alloys, steels, cast iron, ceramic, and resins. The substrate can be formed as any one of plate shapes, cylinder shapes, spherical shapes.

In order to enhance the adhesiveness between the present sliding film and the surface of the substrate, proper roughness can be given to the surface of the substrate (that is, the surface of the substrate can be roughened) by cutting, shot peening, or anodic oxidation treatment. Alternatively, the surface of the substrate can be provided with a thermally-sprayed layer.

A mating is a component part which moves relatively to the present sliding member while contacting slidably with it. The superficial properties and material of the mating member do not matter. However, similarly to the substrate, the mating member can be provided with a sliding film like the present sliding film. The descriptions on the substrate are applicable likewise to the material and shape of the mating member. Note that, in the present specification, a member in which the present sliding film is formed on at least one of the surfaces of the substrate is referred to as the present "sliding member" for descriptive convenience. However, the mating member will also be included in, and will be simply referred to as a "sliding member" wherever appropriate.

The present sliding member demonstrates good sliding characteristics, and is accordingly suitable for components used under severe sliding conditions. For example, such components can be shafts, races or rings of bearings, pistons of internal combustion engines, and swash plates and shoes of swash-plate type compressors for automotive air conditioners.

The required sliding characteristics of sliding members depend on their applications. However, it is appropriate that the thickness of the present sliding film can preferably fall in a range of from 0.1 to 120 μm, further preferably from 5 to 100 μm, furthermore preferably from 5 to 60 μm. Sliding films with too thin thickness can hardly secure stable sliding characteristics for a long period of time. On the other hand, sliding films with too thick thickness are not preferable because it takes longer to form such sliding films to result in high production cost.

(5) Sliding Product

The action of absorbing frictional heat effected by the low-melting-point material is believed to be one of the reasons that the present sliding film demonstrates better seizure resistance, compared with conventional sliding films, as described above. However, the present inventors confirmed that new sliding products were formed on sliding surfaces under specific sliding conditions after the present inventors carried out various tests and analyses repeatedly to earnestly study the present sliding film. The sliding products are believed to contribute more or less to further improving the sliding characteristics between sliding members. Specifically, the sliding products are believed to further facilitate to reduce the friction coefficients between sliding surfaces and improve the wear resistance of sliding films, in addition to the aforementioned seizure-resistance improvement, so that they furthermore upgrade the sliding characteristics, reliability and durability of the present sliding film.

The sliding products are considered new alloys or compounds, which are formed by reacting with the low-melting-point material or a part of the constituent components. Note that the compounds include intermetallic compounds. A sliding-product-forming element, which reacts with the low-melting-point material to form sliding products, can be contained in the present sliding film together with the low-melting-point material, or can be present adjacent to the sliding surface of a mating member which contacts slidably with the present sliding film. However, it is preferable that the present sliding film can comprise both low-melting-point material and sliding-product-forming element, because sliding products can be formed regardless of the components of the mating member.

When a sliding-product-forming element is present on the mating member's side, the transfer of sliding products occurs between the present sliding film's side and the mating member's side. For example, when sliding products are formed on the mating member's sliding surface, the constituent elements of the present sliding film transfer to the mating member. Even when sliding products are formed on the other side, the transfer occurs similarly. Thus, sliding products can be formed on either the present sliding member's side or the mating member's side, or can be formed on both sides. Moreover, sliding products can be formed as a film covering a sliding surface entirely, or a film covering a sliding surface partially. Alternatively, sliding products can be present on a sliding surface in a scattered manner. The form of sliding products' presence does not matter at all.

As some examples of such sliding compounds, nickel alloys and nickel compounds are available which are made of low-melting-point-metals comprising Sn, Pb, In or Bi and Ni, a sliding-product-forming element. For example, when the low-melting-point material includes Sn and the sliding-product-forming element is Ni, sliding products comprise Sn—Ni compounds. Taking a swash-plate type compressor as an example, the present sliding film comprising Sn as the low-melting-point material can be formed on the surface of a swash plate, and a nickel plating can be formed on the surfaces of shoes which contact slidably with the swash plate. In this instance, an Sn—Ni compound layer might be formed as a new sliding product. According to the experiments and researches carried out by the present inventors, it was found that the resulting Sn—Ni compound layer was formed in such a manner that it adhered to the surface of the shoes to form a new sliding surface in which Sn was micro-fined and dispersed.

As a further example, the formation of a "secondary" sliding-product layer is available. When the solid lubricant included $MoS_2$ particles together with Sn, the present inventors noticed that there were cases where sliding-product layers, which comprised Sn—S—Mo compounds and were formed on the surface of the present sliding film by friction at an early stage, were believed to furthermore improve the wear resistance of the present sliding film. Note that there can be instances where a plurality of sliding products are formed successively. In such instances, the sliding products are referred to as and are divided into a "primary" sliding product, a "secondary" sliding product, a "tertiary" sliding product, and so on, respectively, for descriptive convenience. Note that the farther sliding products are formed away from the sliding surface of the present sliding film, with the higher orders they are represented.

(6) Composition for Sliding Film, Process for Forming Sliding Film or Process for Producing Sliding Member A composition for sliding films according to the present invention includes requisite components for forming the present sliding film, that is, the solid lubricant, binder resin and low-melting-point material, minimally. Depending on the specifications of the present sliding film, the present composition can contain the other components. Moreover, the present composition takes forms depending on methods for forming the present sliding film. For example, when the present sliding film is formed on the surface of a substrate by application, the present composition is adapted to be a paint for sliding films in which the binder resin is turned into a varnish. Moreover, when the present sliding film is formed by a transfer method, the present composition is adapted to be a paste for sliding films, for instance, so as to make the resulting transfer film more likely to be screen-printed.

When forming the present sliding film on the surface of a substrate with a paint for sliding films, the forming process comprises the steps of: applying a paint for sliding films onto a surface of a substrate, paint whose viscosity is controlled by a solvent appropriately depending on application methods; and baking a paint film, formed after the applying step, by heating, for example. The applying step can be carried out by brush coating, spray application, and immersion into paint bath. More specifically, it is possible to employ known application methods, such as roller application, roll-coater application, air-spray application, airless-spray application, electrostatic coating, electrodeposition coating, and screen printing.

In the baking step, a paint film applied on the surface of a substrate is heated under predetermined conditions to firmly form a sliding film and simultaneously adhere the resulting sliding film onto the substrate's surface. The baking step can be combined with a drying step for drying the paint film, formed after the applying step. Moreover, when the binder resin comprises a thermosetting resin, the thermosetting resin undergoes cross-liking to cure in the baking step.

When forming the present sliding film on the surface of a substrate by a transfer method, the forming process comprises the steps of: forming a transfer film by screen-printing a paste for sliding films onto a mounting substrate; transferring the resulting transfer film onto a surface of a substrate; and baking the paint film formed on the surface of the substrate, for instance. The processes for forming the present invention have been described so far. However, it is believed that the above descriptions on the forming process can be applied similarly to a process for producing a sliding member according to the present invention.

(7) Sliding Device

A sliding device according to the present invention comprises a sliding member on which the present sliding film is formed; and a mating member contacting slidably with the sliding film of the sliding member. As such a sliding device, it is possible to think of many different kinds of devices. For example, even limiting to the field of automobiles, there are engines, various pumps, and swash-plate type compressors for air conditioners. Hereinafter, a swash-plate type compressor, a compressor for refrigerants for vehicle air-conditioners, will be taken as an example, and the swash plate, on which the present sliding film is formed, will be hereinafter described in detail with reference to accompanying drawings.

FIG. 1 illustrates a cross section of a swash-plate type compressor "C," an embodiment of the present sliding device. The swash-plate type compressor "C" comprises a front housing 16, a cylinder block 10, and a rear housing 18, which are disposed in this order from the left side to the right side in the drawing. The front housing 16, cylinder block 10 and rear housing 18 form a housing 21 in which a rotary shaft 50, a swash plate 60, single-headed pistons 14 (hereinafter abbreviated to as "pistons" 14), and an electromagnetic control valve 90 are disposed.

In the cylinder block 10, a plurality of cylinder-shaped cylinder bores 12 are formed so as to surround the axial center of the cylinder block 10 in an annular manner. The pistons 14 are fitted reciprocably into the respective cylinder bores 12. The front housing 16 is installed to one of the axial opposite end surfaces of the cylinder block 10. The rear housing 18 is installed the other one of the axial opposite end surfaces of the cylinder block 10 by way of a valve plate 20.

An inlet chamber 22 and outlet chambers 24 are disposed between the rear housing 18 and the valve plate 20. The inlet chamber 22 and outlet chambers 24 are connected with a not-shown refrigerator circuit byway of an inlet port 26 and outlet ports 28, respectively. Moreover, the valve plate 20 is provided with an inlet hole 32, an inlet valve 34, outlet holes 36, and outlet valves 38.

The rotary shaft 50 is supported rotatably about the axial middle of the cylinder block 10. One of the opposite ends of the rotary shaft 50 is connected with a not-shown driving source. The swash plate 60 is installed axially movably relatively and inclinably to the rotary shaft 50. The swash plate 60 is provided with a through hole 61 which involves the axial center line of the swash plate 60, and into which the rotary shaft 50 penetrates. The through hole 61 has an inside diameter whose dimension decreases gradually from large to small in the up/down direction toward the opposite-end openings, and accordingly is formed as a slot at the opposite-end openings cross-sectionally. A rotary disk 62 is fixed to the rotary shaft 50, and is further supported rotatably to the front housing 16 by way of a thrust bearing 64.

A hinge mechanism 66 rotates the swash plate 60 together with the rotary shaft 50, and simultaneously makes the swash plate 60 inclinable. Note that the inclining swash plate 60 accompanies an axial movement relative to the rotary shaft 50. The hinge mechanism 66 comprises a support arm 67, a guide pin 69, the through hole 61 of the swash plate 60, and an outer peripheral surface of the rotary shaft 50. The support arm 67 is disposed fixedly to the rotary disk 62. The guide pin 69 is disposed fixedly to the swash plate 60, and is fitted slidably into a guide hole 68 of the support arm 67.

The pistons 14 comprise engagers 70, and heads 72. The engagers 70 engage with an outer periphery of the swash plate 60 in a saddle-like manner. The heads 72 are disposed integrally with the engagers 70, and are fitted slidably into the cylinder bores 12, respectively. The heads 72 are made hollow for weight saving. The heads 72, cylinder bores 12 and valve plate 20 form compression chambers cooperatively. Note that the engagers 70 engage with an outer periphery of the swash plate 60 by way of paired semi-spherical crown-shaped shoes 76. Also note that the pistons 14 are referred to as single-headed pistons because only one of the opposite ends of the engagers 70 is provided with the heads 72.

The rotating swash plate 60 reciprocates the pistons 14. Specifically, the rotary movement of the swash plate 60 is converted into the reciprocate linear movements of the pistons 14 by way of the shoes 76. In the intake stroke during which the pistons 14 move from the top dead centers to the bottom dead centers, a refrigerant gas in the inlet chamber 22 is sucked into the compression chambers in the cylinder bores 12 by way of the inlet hole 32 and inlet valve 34. In the compression stroke during which the pistons 14 move from the bottom dead centers to the top dead centers, the refrigerant gas held within the compression chambers in the cylinder bores 12 is compressed, and is discharged out to the outlet chambers 24 by way of the outlet holes 36 and outlet valves 38. As the refrigerant gas is compressed, compressive reactive forces act axially onto the pistons 14. The front housing 16 receives the compressive reactive forces by way of the pistons 14, swash plate 60, rotary disk 62 and thrust bearing 64.

An aeration passage 80 is disposed so as to penetrate through the cylinder block 10. The aeration passage 80 connects the outlet chambers 24 and a swash-plate chamber 86 which is formed between the front housing 16 and the cylinder block 10. At around the middle of the aeration passage 80, there is disposed the electromagnetic valve 90. A not-shown control apparatus comprising a computer controls the electric-current supply to a solenoid 92 of the electromagnetic valve 90 depending on information about cooling loads.

Inside the rotary shaft 50, there is disposed an exhaust passage 100. One of the opposite ends of the exhaust passage 100 opens to a support bore 102 which is disposed around the center of the cylinder block 10, and the other one of the opposite ends opens to the swash plate chamber 86. Note that the support bore 102 communicates with the inlet chamber 22 by way of an exhaust port 104.

The swash-plate type compressor "C" is a variable-capacity type compressor. That is, the pressure difference between the outlet chambers 24 making a higher pressure side and the inlet chamber 22 making a lower pressure side is utilized to control the pressure within the swash-plate chamber 86. Thus, the pressure difference between the pressure within the swash-plate chamber 86, pressure which acts onto the rear ends of the pistons 14, and the compression-chamber pressures within the cylinder bores 12, compression-chamber pressures which acts onto the front ends of the pistons 14, is controlled. As a result, the inclining angle of the swash plate 60 changes so that the strokes of the pistons 14 change, thereby controlling the outlet capacity of the swash-plate type compressor "C." Note that controlling the pressure within the swash plate-chamber 86 is carried out by communicating the swash-plate chamber 86 with the outlet chambers 24 or shutting off the swash-plate chamber 86 from the outlet chambers 24, accompanied by energizing or de-energizing the electromagnetic control valve 90.

Note that, in the swash-plate type compressor "C" according to the present embodiment, the device for changing the inclination angle of the swash plate 60 comprises the cylinder bores 12, the pistons 14, the inlet chamber 22, the outlet chambers 24, the support bore 102, the aeration passage 80, the swash-plate chamber 86, the electromagnetic control valve 90, the exhaust passage 100, the exhaust port 104, and the not-shown control apparatus, in addition to the above-described hinge mechanism 66.

The cylinder block 10 and pistons 14 are made of aluminum alloys. The outer peripheral surfaces of the pistons 14 are provided with a fluorocarbon-resin coating. The fluorocarbon-resin coating prohibits like metals from contacting directly to enhance the seizure resistance, and simultaneously reduces the fitting space (or clearance) between the pistons 14 and the cylinder bores 12 as less as possible.

The engagers 70 of the pistons 14 are formed roughly as a letter "U" shape in a cross section, and comprise paired arms 120, 122, and connectors 124. The arms 120, 122 extend in directions crossing the central axial lines of the heads 72 parallelly to each other. The connectors 24 connect the base ends of the arms 120, 122 with each other. In the inner lateral surfaces of the arms 120, 122 which face to each other, there are formed concaved spherical surfaces 128, which make shoe-holding surfaces, respectively. Note that these two concaved spherical surfaces 128 are positioned on an identical spherical surface.

Figure 2:
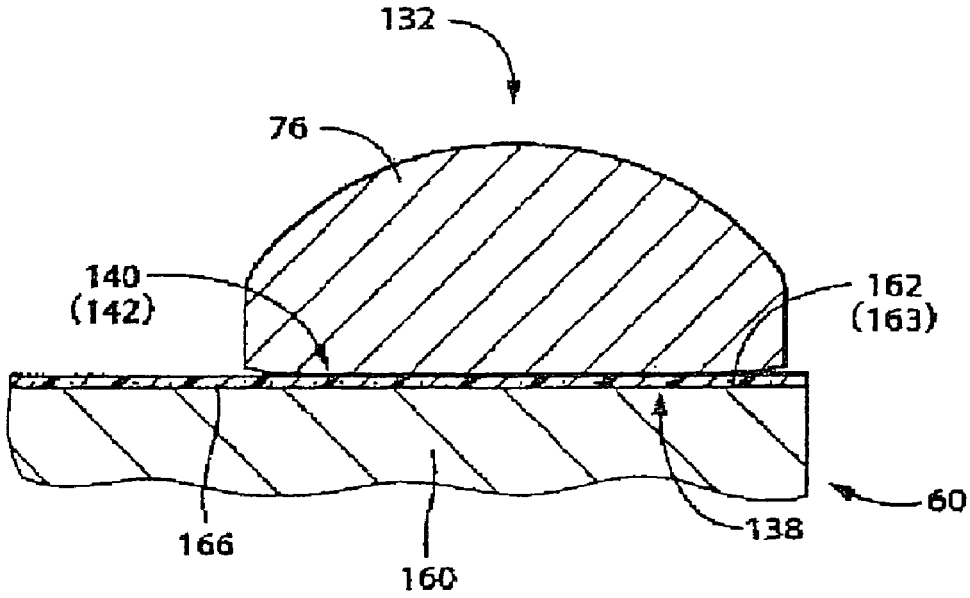
FIG. 2 is an enlarged cross-sectional view for illustrating how a swash plate and a shoe for the swash-plate type compressor contact slidably.

As illustrated in FIG. 2, the shoes 76 are formed semi-spherical crown shapes, and comprise spherical surfaces 132 and flat surfaces 138. The spherical surfaces 132, one of the outer peripheral surfaces of the shoes 76, are formed roughly as a convexed spherical surface. The flat surfaces 138, another one of the outer peripheral surfaces of the shoes 76, are formed roughly plainly. At the spherical surfaces 132, the shoes 76 are held slidably by the concaved spherical surfaces 128 of the pistons 14. At the flat surfaces 138, the shoes 76 contact with opposite sliding surfaces 140, 142, the outer peripheral opposite surfaces of the swash plate 60. Thus, the shoes 76 hold the outer peripheries of the swash plate 60 from the opposite sides. When the shoes 76 thus hold the swash plate 60, the paired shoes 76 are designed so that the convexed spherical surfaces of the spherical surfaces 132 are positioned on an identical spherical surface. That is, the shoes 76 are formed as semi-spherical crown shapes which are smaller than an actual semi-circle by about a half of the thickness of the swash plate 60.

A substrate 160 of the swash plate 60 comprises ductile cast iron, such as FCD700, FCD600 and FCD500 as per Japanese Industrial Standard (hereinafter abbreviated to as "JIS"). Alternatively, the substrate 160 can comprise machine structural carbon steels, such as S45C and S55C as per JIS, chromium molybdenum steels, such as SCM as per JIS, or copper alloys.

On opposite surfaces 162, 163 of the substrate 160, there are formed solid-lubricant layers 166, the sliding film according to the present invention. The solid-lubricant layers 166 comprise a mixture of $MoS_2$, graphite and PTFE (i.e., solid lubricants), a tin fine powder (i.e., the low-melting-point material), and PAI (i.e., the binder resin). The solid-lubricant layers 166 have thickness of from 10 to 20 μm approximately. Note that the solid-lubricant layers 166 are a one and only example of the present sliding film. Depending on the specifications of the swash-plate type compressor "C," it is possible to use the other solid-lubricant layers.

The solid-lubricants layers 166 can be formed in the following manner, for example. A liquid paint (i.e., the present composition for sliding films), which comprises the constituent components of the above-described solid-lubricant layers 166, is adhered uniformly onto an outer surface of the substrate 160 by spraying or transferring. Note that the term, "transferring," herein means screen printing using a paint for roll-coater application. Spraying is a method in which a paint is sprayed onto the substrate 160, which is fastened in advance, to uniformly adhere the paint on the substrate 160. The resulting paint film, formed after the spraying or transferring, is baked to cure. Eventually, an outer surface of the paint film is polished to the solid-lubricant layers 166 with predetermined dimensions and roughness, which are controlled appropriately.

The presence of the solid-lubricant layers 166 can produce the swash plate 60 exhibiting good sliding characteristics, such as sufficient seizure resistance and low friction. As a result, even when operating the swash-plate type compressor "C" under severe circumstances, such as non-lubrication condition or poor lubrication conditions, it is possible to avoid the seizure between the swash plate 60 and the shoes 76 (i.e., between sliding members). Therefore, the swash-plate type compressor "C" can securely demonstrate high durability and reliability.

Note that sliding films similar to the solid-lubricant layers 166 can be formed on the inner peripheral surfaces of the cylinder bores 12 and the surfaces of the heads 72 of the pistons 14, and can be further formed on the outer peripheral surfaces of the shoes 76 and the surfaces of the concaved spherical surfaces 128 of the engagers 70.

The paired shoes 76 have been often made of SUJ2 as per JIS, high-carbon chromium bearing steel, but can be made of aluminum alloys and their surfaces can be provided with nickel plating. Specifically, the paired shoes 76 can comprise a substrate made of an aluminum alloy containing silicon, such as an Al—Si-based alloy equivalent to A4032 as per JIS, and a nickel-based plating film, such as Ni—P, Ni—B, Ni—P—B and Ni—P—B—W plating films, formed on the substrate. Note that the nickel-based plating film can be formed of a single film, or a plurality of different or same kinds of films.

Sliding films like the solid-lubricant layers 166, and the aforementioned nickel-based plating films can cover the surfaces of substrates entirely, or can cover parts of the surfaces of substrates, which are subjected to severe sliding conditions, alone.

As an embodiment of the present sliding device, a variable-capacity swash-plate type compressor is described. However, it is needless to say that the present sliding device is not limited to it. A compressor, one of sliding devices, can be those whose capacities are variable or invariable. Moreover, its compression system can be reciprocal systems, such as swash-plate systems and wobble systems, or rotary systems, such as vane systems and scroll systems. In addition, in the case of compressors for air conditioners, the types of refrigerants do not matter. For example, refrigerants can be alternatives for fluorocarbon, or can even be $CO_2$.

EXAMPLES

Sliding members equipped with a few examples of the present sliding film were produced actually as hereinafter described, and the sliding characteristics of their sliding films were evaluated.

Preparation of Paint for Sliding Film

To a resinous varnish of PAI, the binder resin, the following were added: a PTFE powder, the solid lubricant, having an average particle diameter of from 0.2 to 100 μm; a graphite powder having an average particle diameter of from 0.3 to 10 μm; an $MoS_2$ powder having an average particle diameter of from 3 to 40 μm; and various metallic powders, the low-melting-point material, having an average particle diameter of from 5 to 20 μm. The additives were stirred and dispersed in the resinous varnish. Thus, paints for sliding films were produced.

When the entire formed sliding films were taken as 100% (except the low-melting-point material) by mass (hereinafter simply expressed by "%"), the compounding proportions were controlled as follows: 34.49% for PAI; 20.73% for PTFE; 10.85% for graphite; and 33.93% for $MoS_2$. Note that Table 1 below sets forth the types of the low-melting-point material and their compounding proportions.

Production Method of Samples

In order to simulate an application to the swash plates of swash-plate type compressors, an annular disk was prepared as a substrate. Note that the annular disk was made of cast iron (e.g., FCD700 as per JIS), and has an outside diameter of ϕ 95 mm, an inside diameter of ϕ 16 mm and a thickness of 6 mm. After degreasing and washing the surfaces of the substrate, the above-described various paints for sliding films were applied onto the surfaces by spraying, respectively, while controlling the application amounts (i.e., an applying step). The substrates on which paint films formed were put in a heating furnace holding air, and were then heated at 200° C. for 1 hour to dry and bake paint films (i.e., a baking step). After cooling the substrates, the surfaces of the resulting sliding films were polished to control the thickness of the sliding films to about 10 μm. At this moment, the sliding films exhibited surface roughness Rz of from 1.0 to 3.2 μm as per JIS. Thus, sliding members whose surfaces were covered with the sliding films (i.e., samples) were produced.

In order to simulate the shoes of swash-plate type compressors, a semi-spherical crown-shaped member was employed as a mating member which contacted slidably with the sliding films. The sliding surface of the mating member was formed as a ϕ 13.5-mm circle. The mating member was made of an aluminum alloy (e.g., Al-12% by mass Si-4% by mass Cu). Moreover, the sliding surface of the mating member was subjected to electroless nickel platting. In addition, another mating member was prepared which was made of SUJ2 as per JIS, a bearing steel, and whose sliding surface is not subjected to any plating.

Dry-Lock Test

Figure 3:
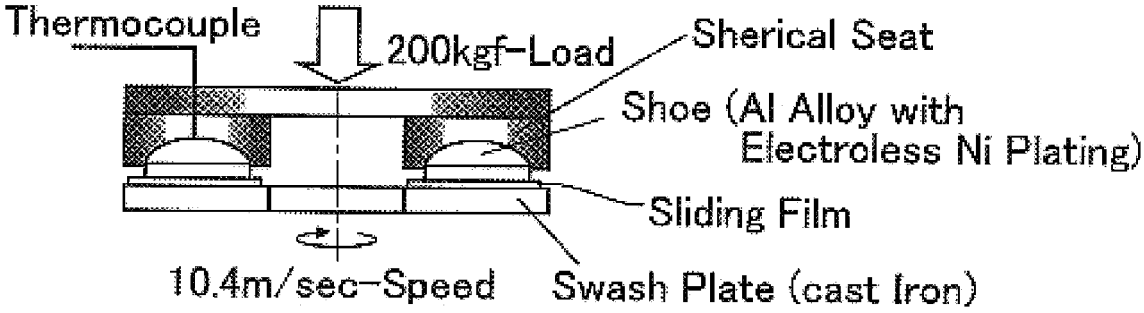
FIG. 3 is a diagram for roughly illustrating a dry-lock testing apparatus used for evaluating the seizure resistance which sliding films exhibited.

Using a dry-lock testing apparatus shown in FIG. 3, seizure times were measured. The seizure times herein mean times for the substrates provided with the sliding films (hereinafter simply referred to as "swash plates") and the nickel-plated mating members (hereinafter simply referred to as "shoes") to seize to each other. The dry-lock testing apparatus applied a predetermined load to the swash plates and shoes, and moved them slidably under non-lubrication condition in a predetermined atmosphere. Thus, the dry-lock testing apparatus could reproduce a situation close to those in actual machines (e.g., swash-plate type compressors) under non-lubrication condition.

Specifically, the dry-lock test was carried out in two testing atmospheres, in a $CO_2$ gas and in a CFCs substitute gas (e.g., R134a). Moreover, as illustrated in FIG. 3, the vertical load applied to the two shoes from above in the drawing was controlled at 200 kgf (i.e., 1,961 N). Note that the swash plate and the shoes were put into planar contact and the pressure exerted between them was about 2 MPa. The sliding speed was controlled at 10.4 m/sec. Note that the sliding speed was an average speed about the center of an imaginary circle on which the swash plate and shoes contacted. To put it differently, the swash plate was rotated at 3,000 rpm, while holding the shoes stationary, and the shoes were moved slidably on the swash plate relatively. In addition, in the spherical seats for holding the shoes, there were buried thermocouples for measuring the temperatures of the shoes.

In order to judge whether seizure occurred or not, a change of torque, which was required for a driving motor to rotate the swash plate at a constant speed, was observed. That is, the change of torque with time was measured continuously, and seizure was judged to occur when the torque increased by 15 kgf·cm or more suddenly.

Table 1 and Table 2 below summarize the results of the thus measured seizure times which the respective sliding films exhibited. Table 1 represents the seizure times which the sliding films exhibited in a testing atmosphere of 2 MPa-$CO_2$ gas when the types and contents (expressed in % by mass when the entire sliding films were taken as 100% by mass) of the low-melting-point material included in the sliding films were changed. Table 2 represents how the seizure times depended on the types of shoes and the testing atmospheres when the sliding films, which employed the Sn-based low-melting-point materials and exhibited especially better sliding characteristics than the other sliding films listed in Table 1, were used.

TABLE 1

| Sample No. | Low-melting-point Material: Type | Low-melting-point Material: Compounding Proportion | Seizure Time (sec.) |
|---|---|---|---|
| 1 | Sn | 9% by mass | 236/321 |
| 2 | Sn | 28% by mass | 354/427 |
| 3 | Pb | 28% by mass | 112 |
| 4 | Bi | 28% by mass | 116 |
| 5 | In | 28% by mass | 156 |
| 6 | Sn | 37% by mass | 281 |
| 7 | Sn | 44% by mass | 144 |
| 8 | Sn—20%Cu | 28% by mass | 56 |
| 9 | None | None | 66 |

Testing Atmosphere: 2 MPa-$CO_2$; and Dry

TABLE 2

| Sample No. | Low-melting-point Material in Sliding Film | Mating Member | Testing Atmosphere (Dry) | Seizure Time (sec.) |
|---|---|---|---|---|
| 10 | Sn: 2% by mass | Al Alloy + Ni Plating | $CO_2$: 2 MPa | 258 |
| 11 | Sn: 9% by mass | Al Alloy + Ni Plating | $CO_2$: 2 MPa | 236/321 |
| 12 | | | R134a: 0.5 MPa | 190 |
| 13 | | Steel (SUJ2) | | 110 |
| 14 | Sn: 28% by mass | Al Alloy + Ni Plating | $CO_2$: 2 MPa | 354/427 |
| 15 | | | R134a: 0.5 MPa | 232 |
| 16 | | Steel (SUJ2) | | 148 |
| 17 | Sn: 37% by mass | Al Alloy + Ni Plating | $CO_2$: 2 MPa | 281 |
| 18 | | | R134a: 0.5 MPa | 185 |
| 19 | | Steel (SUJ2) | | Not Measured |
| 20 | Sn: 44% by mass | Al Alloy + Ni Plating | $CO_2$: 2 MPa | 144 |
| 21 | | | R134a: 0.5 MPa | 140 |
| 22 | | Steel (SUJ2) | | Not Measured |
| 23 | Sn—20%Cu: 28% by mass | Al Alloy + Ni Plating | $CO_2$: 2 MPa | 56 |
| 24 | | | R134a: 0.5 MPa | 58 |
| 25 | | Steel (SUJ2) | | 62 |
| 26 | None | Al Alloy + Ni Plating | $CO_2$: 2 MPa | 66 |
| 27 | | | R134a: 0.5 MPa | 56 |
| 28 | | Steel (SUJ2) | | 64 |

Figure 4:
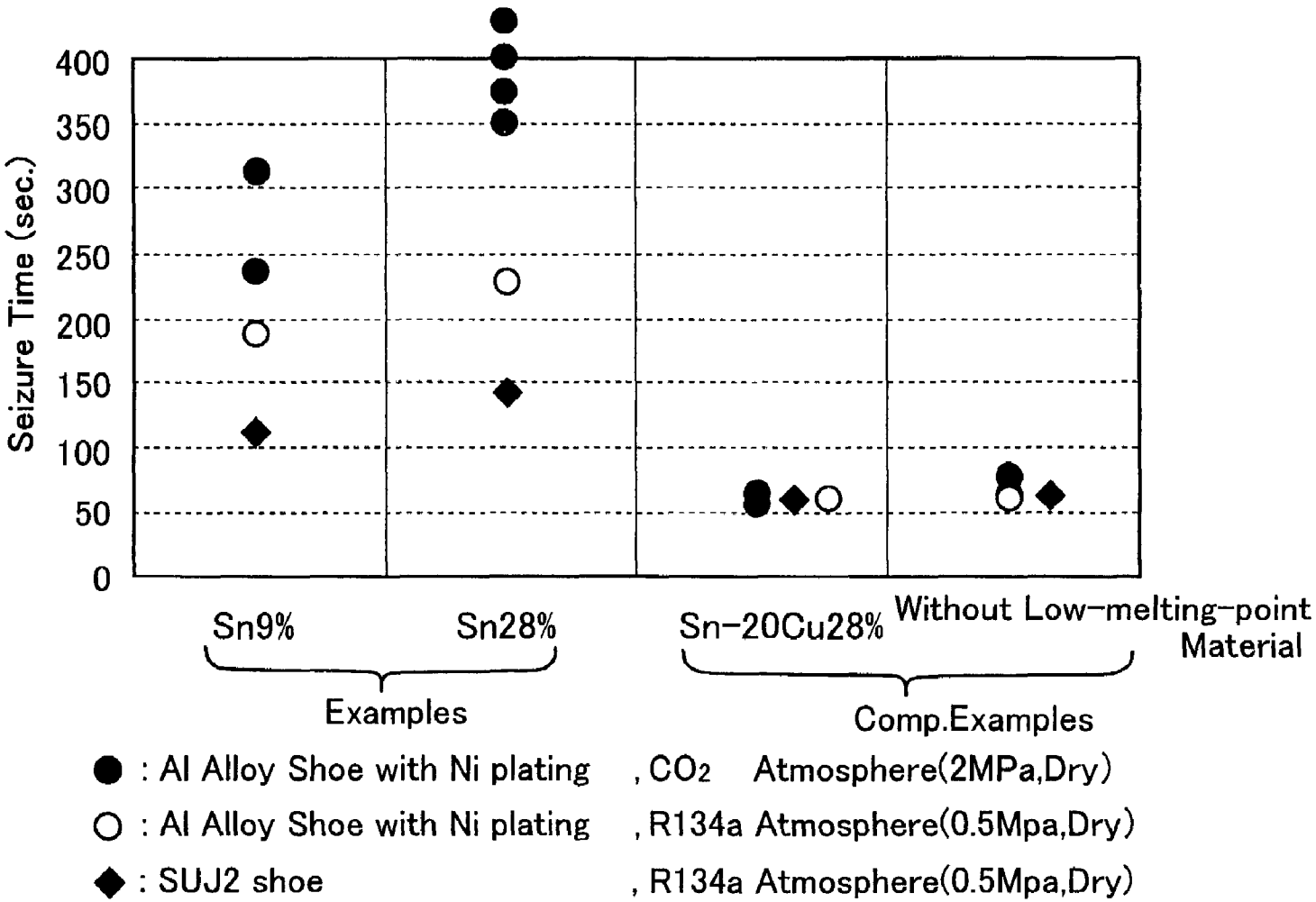
FIG. 4 is a scatter diagram in which seizure times, exhibited by sliding members provided with a variety of sliding films, are plotted.

Note that Sample No. 11, Sample No. 14, Sample No. 17, Sample No. 20, Sample No. 23 and Sample No. 26 in Table 2 are identical with Sample No. 1, Sample No. 2, Sample No. 6, Sample No. 7, Sample No. 8 and Sample No. 9 in Table 1, respectively. Moreover, FIG. 4 illustrates a scatter diagram which was processed from the seizure times set forth in Table 2. In FIG. 4, a plurality of data designated with solid circles "●" are seen because the seizure times fluctuated even under the same testing conditions. In parallel with FIG. 4, Table 2 lists a plurality of seizure times as well.

Ring-on-Block Test

Figure 5:
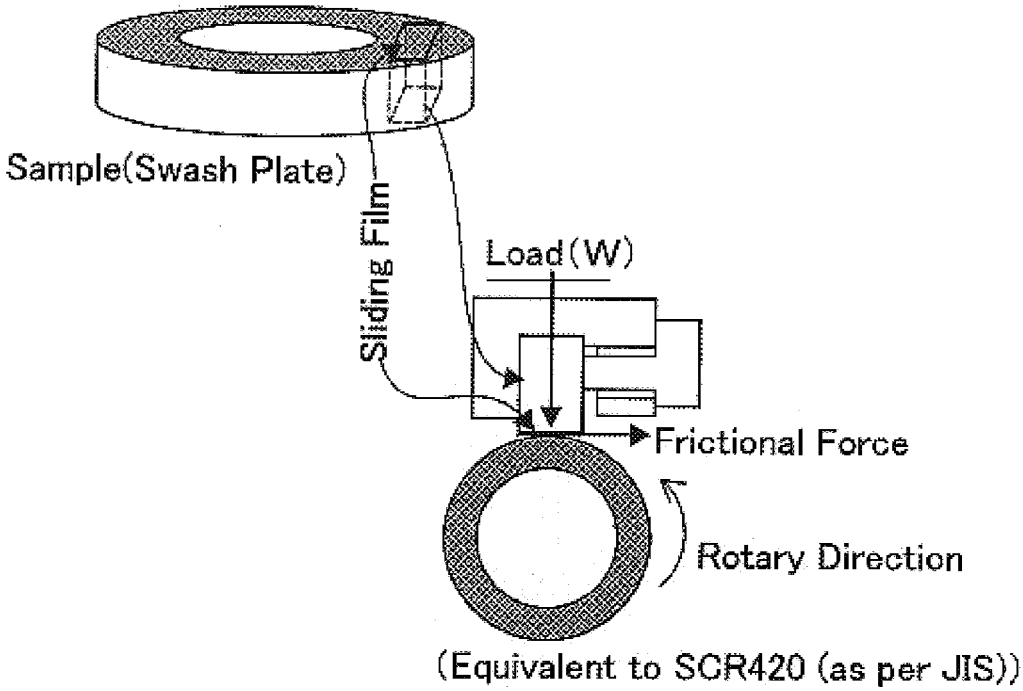
FIG. 5 is a diagram for roughly illustrating a ring-on-block testing apparatus used for evaluating the frictional force which sliding films exhibited.

Using a ring-on-block testing apparatus shown in FIG. 5, sliding members with sliding films provided were examined for the changes of frictional force with time. The ring-on-block testing apparatus moved a square-rod-shaped test piece slidably on a cylinder-shaped mating member under non-lubrication condition (or dry condition) in a predetermined atmosphere while applying a predetermined load to the cylinder-shaped mating member. Then, the ring-on-block testing apparatus measured frictional forces acting onto the sliding surface of the ring-shaped test piece from reaction forces exerted to the ring-shaped test piece. As illustrated in FIG. 5, the test pieces used in the ring-on-block test were square-rod-shaped blocks, which were cut out of annular disks covered with 20 μm-thickness sliding films (i.e., the above-described swash plates). Note that the square-rod-shaped blocks had a size of 6.5 mm in length, 7.0 mm in width and 6.0 mm in height. The outer peripheral surface of the mating member contacted slidably with the sliding films of the test pieces. The mating member was formed as an annular disk whose outside diameter was ϕ 35 mm, and was made of a chromium steel equivalent to SCR420 as per JIS. Moreover, the outer peripheral surface of the mating member was subjected to a carburizing treatment, and was further polished to a surface roughness Rz of 1.7 μm approximately. Note that two types of the test pieces were prepared, namely one comprising Sn, the low-melting-point material in an amount of 20% by mass, and another free from the low-melting-point material.

The ring-on-block test was carried out in air for 10 minutes. A load of 0.87 kgf (i.e., 8.5 N) was applied vertically to the test piece from above in FIG. 5. The mating member was rotated at a constant speed of 100 mm/sec. In other words, the mating member was rotated at a constant speed of 54 rpm while holding the test piece stationary. However, note that, before the ring-on-block test, a so-called breaking-in operation was carried out in which the mating member was rotated at the aforementioned sliding speed for 1 minute while applying a vertical load of 0.22 kgf (i.e., 2.2 N) to the test piece; and then the mating member was rotated at the aforementioned sliding speed for 1 minute while applying a vertical load of 0.44 kgf (i.e., 4.3 N) to the test piece. Also note that the sliding area between the test piece and the mating member enlarged as the ring-on-block test proceeded and accordingly the pressure between them decreased. However, according to an observation on the sliding surfaces of the test piece and mating member after the ring-on-block test, it was supposed that the pressure exerted between them was 10 kgf/cm$^2$ (i.e., 1 MPa) approximately.

Figure 6:
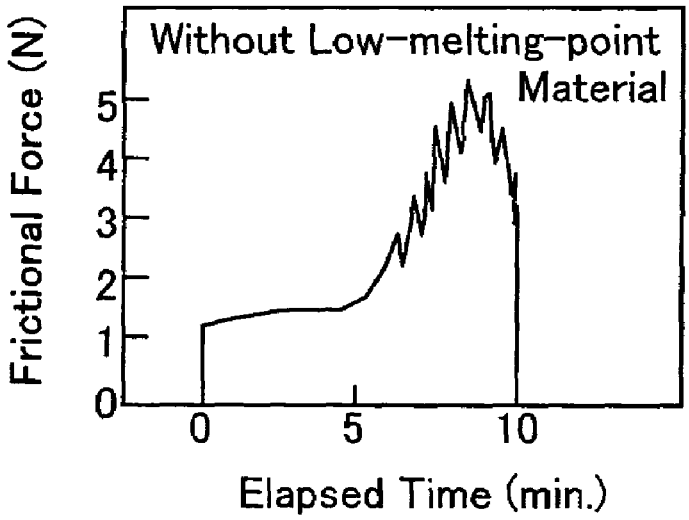
FIG. 6 is a graph for showing a frictional-force variation with time, frictional-force variation which a sliding member free from low-melting-point material exhibited in the ring-on-block test.
Figure 7:
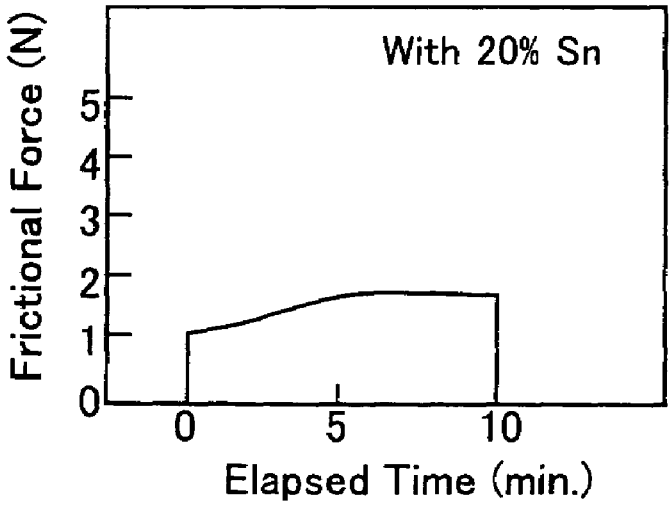
FIG. 7 is a graph for showing a frictional-force variation with time, frictional-force variation which a sliding member comprising Sn, a low-melting-point material, in an amount of 20% by mass exhibited in the ring-on-block test.

FIGS. 6 and 7 illustrate the changes of frictional force with time which resulted from the ring-on-block test. FIG. 6 shows the change exhibited by the sliding film in which no low-melting-point material was present. FIG. 7 shows the change exhibited by the sliding film in which Sn was included in an amount of 20% by mass.

Figure 8:
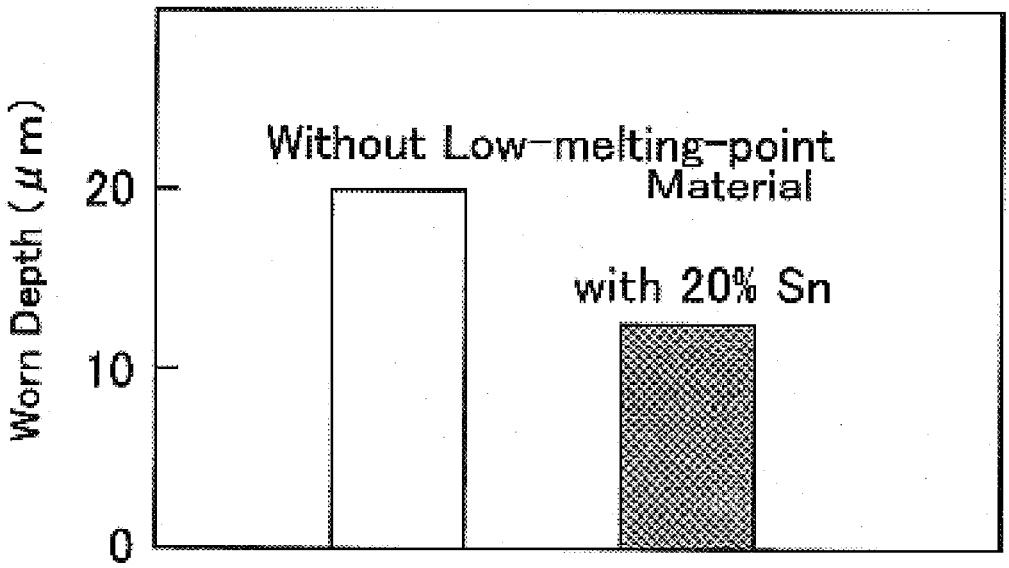
FIG. 8 is a bar graph for comparing maximum worn depths produced in the surfaces of block-shaped test pieces after the ring-on-block test.

Moreover, when the sliding surfaces of the respective test pieces were observed after the ring-on-block test, it was found that the sliding film, which was free from the low-melting-point material, exhibited a worn width of 1.69 mm. When converting the worn width into a worn depth, the worn width equaled a worn depth of about 20.3 μm. ON the other hand, the sliding film, which comprised Sn in an amount of 20% by mass, exhibited a worn width of 1.32 mm. The worn width equaled a worn depth of about 12.4 μm. FIG. 8 illustrates the worn depths for comparison.

Observation with SEM and Analysis with EPMA

Figure 9:
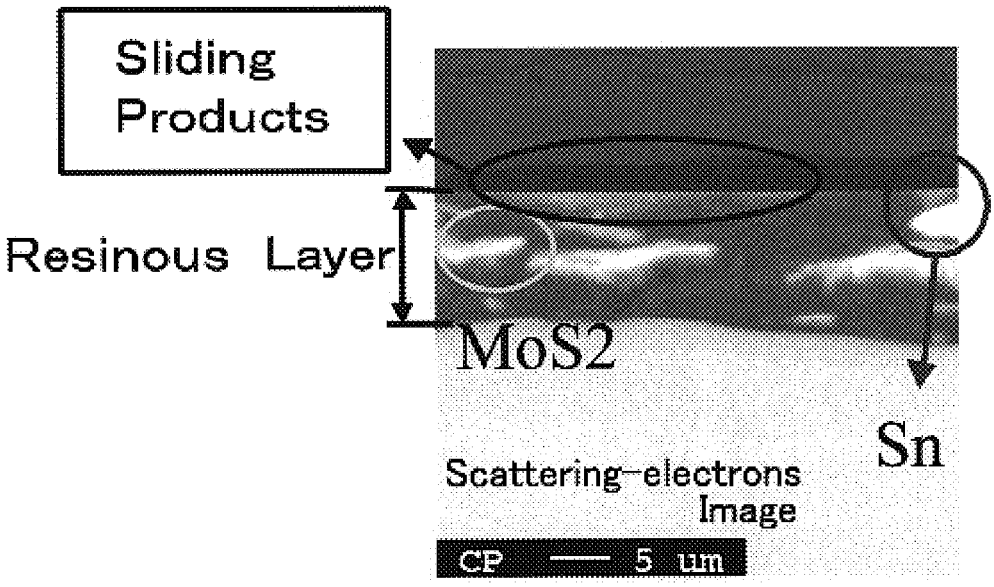
FIG. 9 is a photograph on a sliding film whose Sn content was 28% by mass after the dry-lock test, photograph which was taken by a scanning electron microscope (hereinafter abbreviated to as "SEM").
Figure 10:
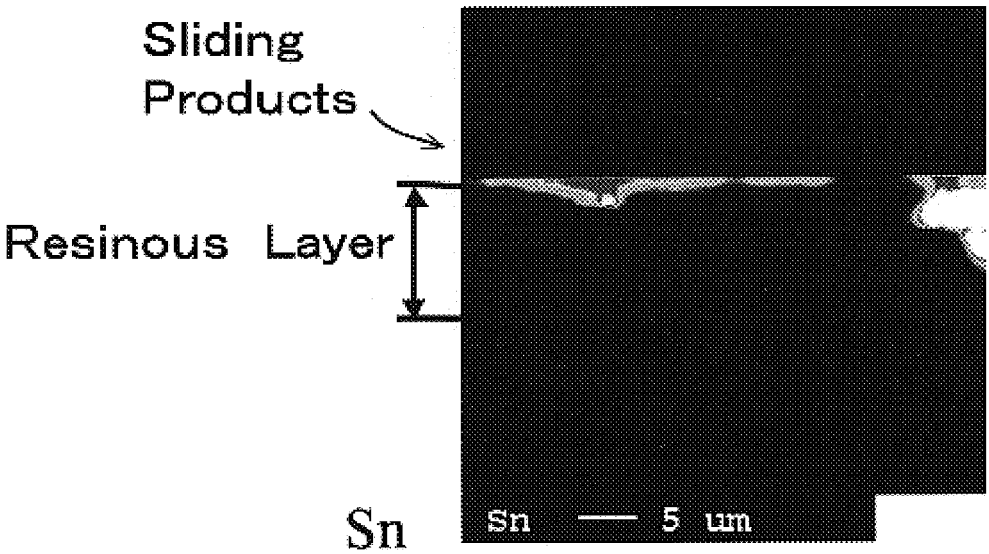
FIG. 10 is a characteristic X-ray image on Sn in a sliding film whose Sn content was 28% by mass after the dry-lock test, characteristic X-ray image which was taken by an electron prove microanalyzer (hereinafter abbreviated to as "EPMA"), and which represents the same part as that of FIG. 9.

After subjecting the swash plate and shoes to the dry-lock test which employed the sample whose sliding film comprised Sn in an amount of 28% by mass, their sliding surfaces were observed with an SEM (i.e., scanning electron microscope) and were further analyzed with an EPMA (i.e., electron probe micro analyzer). Note that the testing conditions of the dry-lock test were identical with those for Sample No. 14 in Table 2. Also note that the observed sliding surfaces experienced the dry-lock test for 150 seconds from the start of the test but before seizure. FIG. 9 represents an SEM photograph on the sliding film. FIG. 10 represents an EPMA photograph on the sliding film.

According to the results of the observation and analysis, it was confirmed that, in the sliding film disposed on the swash plate's side, Sn was not particulate but was distributed extensively in the sliding film, as can be seen from FIG. 10. Moreover, on the surfaces of the shoes with the nickel plating provided, not only Sn but also Ni—Sn compounds (i.e., the sliding products) were identified. In addition, it was further recognized that, on the surfaces of the Ni—Sn compounds, Sn—S—Mo compounds (i.e., the layer of "secondary" sliding products), which were the products of Sn and $MoS_2$ migrating from inside the sliding film, were formed.

Evaluation

It is understood from Table 1, Table 2 and FIG. 4 that the sliding films comprising the low-melting-point materials exhibited seizure times which were extended by from 4 to 5 times longer than those exhibited by conventional sliding films. The present sliding film exhibited the tendency of upgrading seizure time similarly even when the mating members and sliding atmosphere changed. As one of the factors contributing to the advantage, it is believed first of all that, when the particulate low-melting-point materials melted to extensively distribute in the sliding films as can be appreciated from FIG. 10, the low-melting-point materials absorbed the frictional heat and inhibited the sliding films from degrading thermally, thereby extending the longevity of the sliding films. Moreover, as can be seen from FIG. 4, it is apparent that, when the sliding films comprised Sn as the low-melting-point material and the surfaces of the mating members are provided with the nickel plating, the advantage of enhancing the seizure resistance of sliding films was exhibited remarkably.

As can be understood from the results of the above-described analysis with EPMA, the influences of the Ni—Sn compounds (i.e., the sliding products), which were formed anew on the surfaces of the shoes, the mating member, and the influences of the Ni—S—Sn compounds (i.e., the "secondary" sliding products), which were formed on the surfaces of the Ni—Sn compounds, are believed to be a factor for contributing to the seizure resistance improvement. Thus, it is believed that the presence of the sliding products and "secondary" sliding products reduced the friction coefficients between sliding films and consequently might have probably upgraded the seizure resistance of sliding films as well. The fact is fully inferable from the results illustrated in FIG. 6, FIG. 7 and FIG. 8. That is, as illustrated in FIG. 6, the conventional sliding film free from the low-melting-point material exerted the frictional force which increased suddenly and fluctuated thereafter after it moved slidably on the mating member under non-lubrication (or dry) condition for about 5 minutes continuously. The phenomenon is believed to result from the occurrence of seizure. On the other hand, as illustrated in FIG. 7, the present sliding film comprising the low-melting-point material exerted the stable frictional force, namely the friction coefficient between the present sliding film and the mating member was stable, all through the ring-on-block test. The advantage is believed to result from the fact that the stable friction characteristics could be retained to inhibit the occurrence of seizure, though the sliding operation was carried out under non-lubrication (or dry) condition.

Moreover, as can be appreciated from the results summarized in Table 2 and shown in FIG. 4, it was confirmed that the swash plates provided with the sliding films comprising Sn demonstrated remarkably good seizure resistance, which was equivalent to or better than the seizure resistance exhibited by conventional sliding films in CFCs substitute atmospheres, even under the severe circumstances as they are subjected to a high pressure of 2 MPa in a $CO_2$ gas atmosphere. It was acknowledged as well that not only sliding films comprising Sn in an amount of 28% by mass or more naturally could produce such high seizure resistance but also even sliding films comprising Sn in an amount of 2% by mass approximately could yield the advantage satisfactorily.

Note that the Sn-based material involves an Sn-20% by mass Cu which exhibits a liquidus temperature of 545° C., that is, whose melting point is much higher than the glass transition temperature of the binder resin (e.g., PAI). However, the sliding film in which the Sn-20% by mass Cu was mixed did not produce the above-described advantages, and exhibited the seizure resistance equivalent to that of conventional sliding films which did not contain any low-melting-point material at all.

Moreover, when measuring the superficial temperatures of the shoes during the dry-lock test, the sliding films comprising the low-melting-point materials exhibited gentler temperature increments, compared with those exhibited by the sliding films free from the low-melting-point material. The following are believed to be factors contributing to the advantage; the melting low-melting-point materials showed the effect of absorbing the frictional heat; and the sliding products stabilized the friction coefficients between the sliding films and the mating members, as described above.

Having now fully described the present invention, it will be apparent to one of ordinary skill in the art that many changes and modifications can be made thereto without departing from the spirit or scope of the present invention as set forth herein including the appended claims.

What is claimed is:

1. A sliding film, comprising:

a solid lubricant;

a binder resin for holding the solid lubricant on a surface of a substrate, the binder resin exhibiting a glass transition temperature; and a low-melting-point material exhibiting a melting point lower than the glass transition temperature of the binder resin;

wherein the sliding film further comprises a sliding-product-forming element reacting with the low-melting-point material and being capable of forming a new sliding product with good sliding characteristics on a sliding surface.

2. The sliding film set forth in claim 1, wherein the low-melting-point material comprises at least one material selected from the group consisting of metallic simple substances, alloys and compounds.

3. The sliding film set forth in claim 1, wherein the low-melting-point material comprises at least one material selected from the group consisting of low-melting-point metallic simple substances including at least one element selected from the group consisting of tin (Sn), lead (Pb), indium (In) and bismuth (Bi), alloys including at least one of the elements, and compounds including at least one of the elements.

4. The sliding film set forth in claim 1 comprising the low-melting-point material in an amount of from 0.1 to 60% by mass with respect to the entirety taken as 100% by mass.

5. The sliding film set forth in claim 1, wherein:

the low-melting-point material comprises at least one low-melting-point metal selected from the group consisting of Sn, Pb, In and Bi;

the sliding-product-forming element comprises nickel (Ni); and the sliding product comprises at least one member selected from the group consisting of nickel alloys and nickel compounds, the nickel alloys and nickel compounds composed of at least one low-melting-point metal selected from the group consisting of Sn, Pb, In and Bi.

6. The sliding film set forth in claim 5, further comprising a secondary sliding product formed on the sliding surface.

7. The sliding film set forth in claim 6, wherein the secondary sliding product comprises a Sn—S—Mo compound.

8. The sliding film set forth in claim 1, further comprising a secondary sliding product formed on the sliding surface.

9. The sliding film set forth in claim 8, wherein the secondary sliding product comprises a Sn—S—Mo compound.

10. A sliding member, comprising:

a substrate; and the sliding film set forth in claim 1 and formed on a surface of the substrate.

11. The sliding member set forth in claim 10 making a swash plate for swash-plate type compressors.

12. A sliding device, comprising:

a substrate on which the sliding film set forth in claim 1 is formed; and a mating member contacting slidably with the sliding film of the substrate.

13. A swash-plate type compressor, comprising:

a main shaft;

a swash plate rotating together with the main shaft;

a cylinder block having a cylinder-shaped cylinder bore extending axially and opened on a swash-plate side;

a piston having an engager engaging with the swash plate, and being driven by the swinging swash plate, and a head extending continuously from the engager, being fitted into the cylinder bore of the cylinder block, and reciprocating in the cylinder bore depending on the swinging swash plate;

a pair of shoes held swingably to the engager of the piston, and contacting slidably with a surface of the swash plate; and the sliding film set forth in claim 1 formed on at least one of surfaces of the swash plate and the shoes.

14. The swash-plate type compressor set forth in claim 13 comprising:

the sliding film formed on one of the surfaces of the swash plate and the shoes;

a sliding-product-forming element on the other surface of the swash plate and the shoes;

a new sliding product with good sliding characteristic on the surface where the sliding-product-forming element is present, being formed by the sliding-product-forming element reacting with the low-melting-point material in the sliding film.

15. The swash-plate type compressor set forth in claim 14, wherein:

the low-melting-point material comprises Sn;

the sliding-product-forming element comprises Ni; and the sliding compound comprises an Sn—Ni compound.

16. The swash-plate type compressor set forth in claim 15, wherein:

the solid lubricant included in the sliding film comprises at least one member selected from the group consisting of polytetrafluoroethylene, molybdenum disulfide and graphite; and the binder resin included in the sliding film comprises polyamide-imide.

17. The swash-plate type compressor set forth in claim 14, wherein the sliding film is formed on the surface of the swash plate, and the sliding-product-forming element is formed on the surface of the shoes, and the new sliding product is formed on the surface of the shoes.

18. The swash-plate type compressor set forth in claim 14, wherein the sliding film is formed on the surface of the shoes, and the sliding-product-forming element is formed on the surface of the swash plate, and the new sliding product is formed on the surface of the swash plate.

19. The swash-plate type compressor set forth in claim 13 comprising:

the sliding film formed on one of the surfaces of the swash plate and the shoes;

a sliding-product-forming element on the other surface of the swash plate and the shoes where the sliding film is present;

a new sliding product with good sliding characteristic on the other surface of the swash plate and the shoes, being formed by the sliding-product-forming element reacting with the low-melting-point material in the sliding film.

20. The swash-plate type compressor set forth in claim 13 comprising:

the sliding film formed on one of the surfaces of the swash plate and the shoes;

a sliding-product-forming element on the surface of the swash plate and the shoes where the sliding film is present;

a new sliding product with good sliding characteristic on the surface of the swash plate and the shoes, being formed by the sliding-product-forming element reacting with the low-melting-point material in the sliding film.

21. A process for forming a sliding film, comprising:

applying a paint for sliding films onto a surface of a substrate, the paint comprising:

a varnish of a binder resin exhibiting a glass transition temperature;

a low-melting-point material exhibiting a melting point lower than the glass transition temperature of the binder resin, and dispersed in the varnish; and a solid lubricant dispersed in the varnish; and baking a paint film, formed after the applying step, by heating, thereby producing the sliding film set forth in claim 1.

22. A process for producing a sliding member comprising a substrate and a sliding film formed on a surface of the substrate by the process set forth in claim 21.

23. A process for forming a sliding film, comprising:

transferring a transfer film, made by printing a paste, onto a surface of a substrate, the paste comprising:

a binder resin exhibiting a glass transition temperature;

a low-melting-point material exhibiting a melting point lower than the glass transition temperature of the binder resin, and mixed with the binder resin; and a solid lubricant mixed with the binder resin; and baking the transfer film formed, on the surface of the substrate after the transferring step, by heating, thereby producing the sliding film set forth in claim 1.

24. The process for producing a sliding member comprising a substrate and a sliding film formed on a surface of the substrate by the process set forth in claim 23.

25. The sliding film set forth in claim 1, wherein the binder resin is a thermosetting resin.

26. The sliding film set forth in claim 25, wherein the thermosetting resin is polyamidimide.

27. A composition for sliding films, the composition comprising:

a solid lubricant;

a binder resin exhibiting a glass transition temperature; and a low-melting-point material exhibiting a melting point lower than the glass transition temperature of the binder resin;

wherein the sliding film further comprises a sliding-product-forming element reacting with the low-melting-point material and being capable of forming a new sliding product with good sliding characteristics on a sliding surface.

* * * * *

UNITED STATES PATENT AND TRADEMARK OFFICE

CERTIFICATE OF CORRECTION

PATENT NO. : 7,331,274 B2
APPLICATION NO. : 11/133848
DATED : February 19, 2008
INVENTOR(S) : Manabu Sugiura et al.

It is certified that error appears in the above-identified patent and that said Letters Patent is hereby corrected as shown below:

In the Specification

Column 1, line 32, please delete "sliding surfaces basically." and insert therefore -- sliding surfaces. --;

Column 1, lines 52 and 53, please delete "abbreviated to as" and insert therefore -- abbreviated as --;

Column 2, lines 27-28, please delete "some of undercoating treatments for the sliding film" and insert therefore -- as some of the undercoating treatments that may be used for the sliding film --;

Column 2, line 49, please delete "have been repeated trials" and insert therefore -- have been through repeated trials --;

Column 3, line 10, please delete "reduce friction coefficients" and insert therefore -- reduces friction coefficients --;

Column 3, line 37, please delete "have become much severer recently." and insert therefore -- have become more severe recently. --;

Column 3, line 41, please delete "the frictional heat generates more or less." and insert therefore -- more frictional heat is generated. --;

Column 3, line 46, please delete "disperse the pressure" and insert therefore -- disperses the pressure --;

Column 3, line 47, please delete "and because the lubricant" and insert therefore -- and the lubricant --;

Column 3, lines 48-49, please delete "the frictional heat generates less." and insert therefore -- less frictional heat is generated. --;

Column 3, line 60, please delete "abbreviated to as" and insert therefore -- abbreviated as --;

Column 3, lines 62-63, please delete "approximately However," and insert therefore -- approximately. However, --;

UNITED STATES PATENT AND TRADEMARK OFFICE

CERTIFICATE OF CORRECTION

PATENT NO. : 7,331,274 B2
APPLICATION NO. : 11/133848
DATED : February 19, 2008
INVENTOR(S) : Manabu Sugiura et al.

It is certified that error appears in the above-identified patent and that said Letters Patent is hereby corrected as shown below:

Column 4, line 31, please delete "some of the factors that the" and insert therefore -- some of the factors that contribute to the --;

Column 4, line 32, please delete "demonstrates good seizure resistance." and insert therefore -- demonstrating good seizure resistance. --;

Column 6, line 40, please delete "which forms a part" and insert therefore -- which form a part --;

Column 7, lines 4 and 8, please delete "abbreviated to as" and insert therefore -- abbreviated as --;

Column 7, lines 30-32, please delete "Moreover, it should be noted that it depends on objects and performance requirements which one of the following specific embodiments is optimal." and insert therefore -- Moreover, it should be noted that the present invention depends on one of the following specific embodiments where objects and performance requirements are optimal. --;

Column 8, line 33, please delete "material is too less," and insert therefore -- material is too small, --;

Column 10, lines 2-3, please delete "abbreviated to as" and insert therefore -- abbreviated as --;

Column 10, lines 10-11, please delete "The binder resin can not necessarily comprise a single species of resins, or can comprise" and insert therefore -- The binder resin need not necessarily comprise a single species of resins, but can comprise --;

Column 10, line 12, please delete "resin cannot" and insert therefore -- resin need not --;

Column 10, line 32, please delete "Too less proportion" and insert therefore -- Too little proportion --;

Column 10, line 40, please delete "binder resin depending on using solid lubricants" and insert therefore -- binder resin depending on the use of solid lubricants --;

UNITED STATES PATENT AND TRADEMARK OFFICE

CERTIFICATE OF CORRECTION

PATENT NO. : 7,331,274 B2
APPLICATION NO. : 11/133848
DATED : February 19, 2008
INVENTOR(S) : Manabu Sugiura et al.

It is certified that error appears in the above-identified patent and that said Letters Patent is hereby corrected as shown below:

Column 11, line 6, please delete "can preferably from" and insert therefore -- can preferably be from --;

Column 11, line 13, please delete "Too less solid-lubricant" and insert therefore -- Too little solid lubricant --;

Column 11, line 15, please delete "too much solid-lubricant" and insert therefore -- too much solid lubricant --;

Column 11, line 26, please delete "the base of sliding member" and insert therefore -- the base of a sliding member --;

Column 11, line 32, please delete "cylinder shapes, spherical shapes." and insert therefore -- cylinder shapes, and spherical shapes. --;

Column 12, lines 2-3, please delete "to result in high production cost." and insert therefore -- resulting in high production cost. --;

Column 12, line 19, please delete "to reduce the friction coefficients" and insert therefore -- the reduction of the friction coefficients --;

Column 12, line 66, please delete "researches carried out" and insert therefore -- research carried out --;

Column 13, lines 17-19, please delete "Note that the farther sliding products are formed away from the sliding surface of the present sliding film, with the higher orders they are represented." and insert therefore -- Note that the farther away the sliding products are formed from the sliding surface of the present sliding film, the higher the order used to represent them. --;

Column 14, line 38, please delete "housing 18 is installed the other one" and insert therefore -- housing 18 is installed to the other one --;

Column 16, line 23, please delete "cylinder bores 12 as less as possible." and insert therefore -- cylinder bores 12 to as little as possible. --;

UNITED STATES PATENT AND TRADEMARK OFFICE

CERTIFICATE OF CORRECTION

PATENT NO. : 7,331,274 B2
APPLICATION NO. : 11/133848
DATED : February 19, 2008
INVENTOR(S) : Manabu Sugiura et al.

It is certified that error appears in the above-identified patent and that said Letters Patent is hereby corrected as shown below:

Column 16, line 25, please delete "cross section" and insert therefore -- cross-section --;

Column 16, line 28, please delete "parallely to each other." and insert therefore -- parallel to each other. --;

Column 16, lines 30-31, please delete "which face to each other," and insert therefore -- which face each other, --;

Column 16, lines 36-37, please delete "formed semi-spherical crown shapes," and insert therefore -- formed as semi-spherical crown shapes, --;

Column 17, line 4, please delete "the solid-lubricant layers 166" and insert therefore -- the solid lubricant layers 166 --;

Column 17, lines 7-8, please delete "use the other solid-lubricant layers." and insert therefore -- use other solid lubricant layers. --;

Column 21, line 35, please delete "ON the" and insert therefore -- On the --;

Column 22, line 25, please delete "shoes, the mating member," and insert therefore -- shoes and the mating member, --; and Column 23, line 13, please delete "the advantage;" and insert therefore -- the advantage: --.

Signed and Sealed this

Third Day of November, 2009

David J. Kappos

David J. Kappos
*Director of the United States Patent and Trademark Office*